US006063458A

United States Patent [19]

Robertson et al.

[11] Patent Number: 6,063,458

[45] Date of Patent: May 16, 2000

[54] FOLDED IDENTIFICATION TAGS

[75] Inventors: John A. Robertson, Chillicothe; Walter Nickolaus Arth, Jr., Washington Court House; Edward S. O'Neal, Rockbridge; Ken R. Vaughn, Kingston, all of Ohio

[73] Assignee: Infosight Corporation, Chillicothe, Ohio

[21] Appl. No.: 09/248,409

[22] Filed: Feb. 11, 1999

[51] Int. Cl.[7] ..... A47G 1/12

[52] U.S. Cl. ..... 428/13; 428/195; 428/204; 428/209; 428/213; 428/457; 428/594; 427/289; 229/74; 228/146; 228/164; 228/173.1; 219/76.1

[58] Field of Search ..... 428/209, 195, 428/213, 457, 204, 594, 13; 228/176, 182, 141.1, 164, 146, 173.1; 219/76.1; 229/74; 427/289

[56] References Cited

U.S. PATENT DOCUMENTS 5,484,099 1/1996 Robertson et al. ..... 228/176
5,714,234 2/1998 Robertson ..... 428/195

*Primary Examiner*—Deborah Jones
*Assistant Examiner*—Abraham Bahta
*Attorney, Agent, or Firm*—Mueller and Smith, LPA

[57] ABSTRACT

Broadly, the present invention is directed to a method for making a metal tag bearing visible indicia thereon and which can be welded onto a workpiece. Such inventive method commences by providing a metal sheet having a top face, a bottom face, and a pair of ends. The top face bears a painted zone upon which is imprinted with visible indicia. At least one of the ends of the bottom face has exposed bare metal. Such bare metal end is folded so as to reveal the bottom face bare metal adjacent to the imprinted painted zone. The thickness of the folded ends is effective for the metal tag to be welded onto a metal workpiece at such folded tag end. Another aspect of the present invention is a metal tag bearing indicia thereon and which can be welded onto a metal workpiece. The tag includes a metal sheet having a top face, a bottom face, and a pair of ends. The top face bears a painted zone upon that is imprinted with visible indicia. At least one of the ends of the bottom face having exposed bare metal which bare metal end having been folded so as to reveal the bottom face bare metal adjacent to the imprinted painted zone, whereby the metal tag can be welded onto a metal workpiece at the folded tag end.

20 Claims, 5 Drawing Sheets

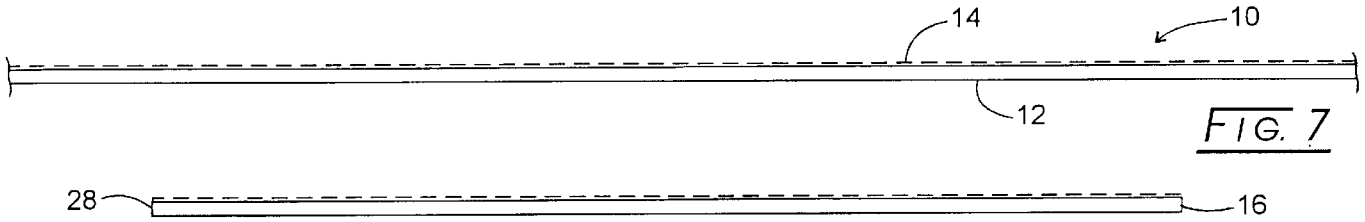
FIG. 7
FIG. 8
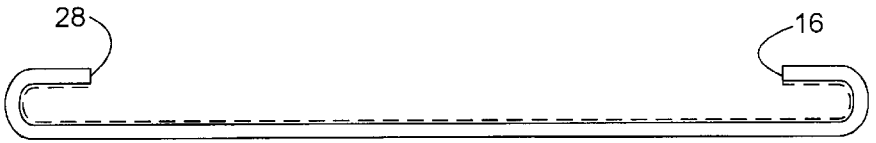
FIG. 9
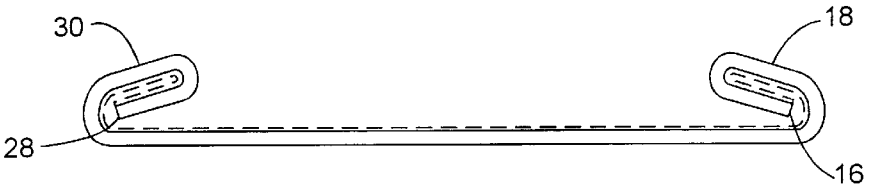
FIG. 10
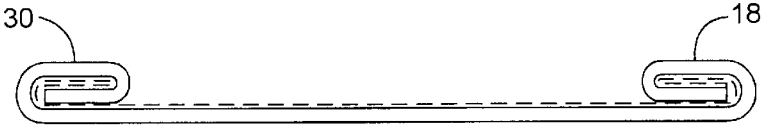
FIG. 11
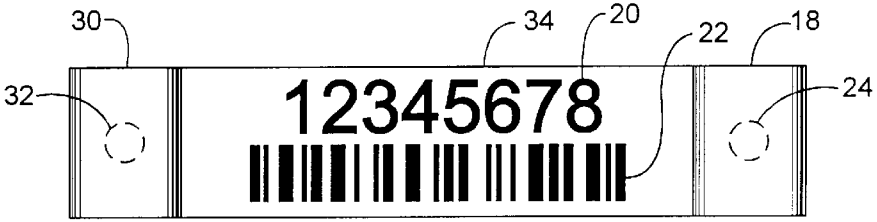
FIG. 12

FOLDED IDENTIFICATION TAGS

CROSS-REFERENCE TO RELATED APPLICATIONS

None.

STATEMENT REGARDING FEDERALLY SPONSORED RESEARCH

Not applicable.

BACKGROUND OF THE INVENTION

The present invention relates to the marking of metal for tracking and identification purposes, and more particularly to imprinted metal tags which can be weld attached to metal workpieces.

Primary metal mills require that their products be accurately identified. Molten metal batches have unique "heat" (batch) chemistries that affect the mechanical properties of the ultimate (further formed) end products. Tracking the many individual pieces produced from a heat is a difficult, time consuming process with many opportunities for error in the stressful (hot, noisy, dimly lit, and physically dangerous) mill environment.

Metals first exit the molten heat as very hot (e.g., 1,800° F. or 982° C.) slabs or billets. Ideally, these slabs and billets should be identified with bar coded information immediately after they solidify and while they are still on the run out tables (before they can be mixed up). Automatic identification (e.g., bar codes) are preferred because they help eliminate the errors inherent in manual marking and reading (estimated by some to be as high as 1 in 300 attempts).

High temperature tags (some with bar codes) have been used for some time. For example, one commercial tag (supplied by Pannier Corp., Pittsburgh, Pa.) is a relatively thin (e.g. 0.008 in or 0.2032 mm thick) stainless steel tag which is coated with a high temperature white coating and is printable on-site using a dot matrix impact (inked ribbon) printer. These tags then are manually affixed to the slab or billet using a powder charged or pneumatically driven nail gun. Efforts to automate this prior art tag have generally not been successful because the dot matrix printer mechanism is "delicate" (dot matrix head and ribbon) and does not survive well in the vicinity of hot/dirty products; and the printer ribbon needs frequent replacement (e.g., every 300 tags), especially if high contrast bar codes are desired. Further, the nailing mechanism is difficult to automate as the environment is not conducive to bowl feeders. Nail "sticks" are limited to, say, 50 nails and stick feeds are unproved. Also, nailing becomes less acceptable (it is a foreign imperfection) and attachment is less reliable in premium (harder) grades of metal. Finally, nailing is increasingly unreliable as the product cools (hardens).

Another proposal is found in U.S. Pat. No. 5,422,167 that discloses a label that is formed from a sheet of metal having a face and a back. The sheet face is coated with a layer of paint that is resistant to temperature of the hot metal stock and receptive to being thermally transfer printed. The metal sheet label is of a thickness so that the paint layer can be thermally transfer printed using conventional markers designed for paper or films. The printed label is adapted to be attached to hot 1,200° F. or 649° C.) metal stock by welding bare (unpainted) zones of the label. This tag system can withstand the rigors of, for example, steel coil or "hot bands" production and can be attached by welding.

One acceptable solution to the problems identified is set forth in commonly-assigned U.S. Pat. No. 5,714,234 which is directed to a method for making a metal tag bearing visible indicia thereon that can be welded onto a substrate or workpiece. Such inventive method commences by providing a metal sheet having (1) a painted zone upon which is imprinted visible indicia, and (2) a bare metal zone, to form the tag. A preform is attached to the bare metal zone, preferably by welding. The preform has a depression adapted to receive weld wire for welding said tag to said metal workpiece. Preferably, the depression is a hole penetrating through the preform to the bare metal zone. The preform also is thicker than the metal tag, and of thickness effective for it being attached to metal by welding. The metal tag is attached to the workpiece by inserting a weld wire through the preform hole to make contact with the tag bare metal zone and welding the metal tag to said workpiece.

While such preform attachment approach in U.S. Pat. No. 5,714,234 represents a significant advancement in this field, there are certain disadvantages with it including cost, the need to remove coating from the area where the preforms are to be welded on, and the need for a spacer in the center of the tag to prevent its sagging. Thus, there still exists a need in the art for a tag and identification system that can withstand the rigors of primary metal mills and in which the tag production and affixation are automated in order to provide significant labor savings (e.g., at least 1 worker per shift) and to eliminate the errors resulting from manual application (e.g., shuffled tags, sequences out of step by one, and the like), and which overcomes the disadvantages inherent in the preform technology represented by U.S. Pat. No. 5,714,234.

Additionally, a variety of other raw and finished goods (e.g., automobile mechanical parts, tires, etc.) require marking for identification purposes. Such goods may be at or below room temperature when the marking requirement arises. A system that has the flexibility to mark "hot" metal as well as lower temperature items would be welcome.

BRIEF SUMMARY OF THE INVENTION

Broadly, the present invention is directed to a method for making a metal tag bearing visible indicia thereon and which can be welded onto a workpiece. Such inventive method commences by providing a metal sheet having a top face, a bottom face, and a pair of ends. The top face bears a painted zone upon which are imprinted visible indicia. At least one of the ends of the bottom face has exposed bare metal. Such bare metal end is folded so as to reveal the bottom face bare metal adjacent to the imprinted painted zone. The thickness of the folded ends is effective for the metal tag to be welded onto a metal workpiece at such folded tag end.

Another aspect of the present invention is a metal tag bearing indicia thereon and which can be welded onto a metal workpiece. The tag includes a metal sheet having a top face, a bottom face, and a pair of ends. The top face bears a painted zone upon which are imprinted with visible indicia. At least one of the ends of the bottom face having exposed bare metal which bare metal end having been folded so as to reveal the bottom face bare metal adjacent to the imprinted painted zone, whereby the metal tag can be welded onto a metal workpiece at the folded tag end.

Advantages of the present invention include an identification system that can withstand the rigors of primary metal mills, yet can be fully automated. Another advantage is an identification system that can provide both alphanumeric characters as well as graphics. A further advantage is the ability to use thin, preferably stainless steel tags, yet be able to attach such tags to hot scaly metal billets and slabs. Yet another advantage is the ability to reliably attach the inventive tags to cold and hot workpieces by conventional MIG welding techniques. These and other advantages will be readily apparent to those skilled in the art based on the disclosure contained herein.

BRIEF DESCRIPTION OF THE DRAWINGS

For a fuller understanding of the nature and objects of the present invention, reference should be had to the following detailed description taken in connection with the accompanying drawings in which:

FIG. 7 is a side sectional view of coated, marked, roll stock metal tag material like that depicted in FIG. 1;

FIG. 8 is the roll stock of FIG. 7 which has been sheared at both ends to create tag stock;

FIG. 9 is the roll stock tag stock of FIG. 8 wherein both ends are being once-folded like that folding described in FIG. 3;

FIG. 10 is the once-folded tag stock of FIG. 9 wherein both ends are being folded a second time like that folding described in FIG. 4;

FIG. 11 is the completed twice-folded tag stock like that described in FIG. 5;

FIG. 12 is an overhead view of the of the twice-folded roll tag stock of FIG. 11, like that described in FIG. 6, showing visible indicia in the form of numbers and a corresponding picket fence bar code, wherein the twice-folded end is suitable for typical MIG weld attachment to a metal product;

The drawings will be described in detail below.

DETAILED DESCRIPTION OF THE INVENTION

Hot slabs or billets typically are at a temperature of up to about 1850° F. At much higher temperatures, ceramic adhesives could be used to affix labels to steel or other metal products; however, they usually crack upon cooling due to temperature coefficient differences. At temperatures much below about 600° F., organic adhesives can be used to affix labels to metal products. Above 1200° F., however, neither ceramic nor organic adhesives are appropriate for affixing or securing labels to hot slabs or billets. Thus, the ability to weld the inventive labels to the hot slabs or billets itself represents advancement in the tagging of hot stock.

With relatively thin tags using MIG (GMAW or gas metal arc welding, see *Welding Handbook*, Volume 2, Eighth Edition, American Welding Society, Chapter 4, pages 110–155) or TIG (GTAW or gas tungsten arc welding, see *Welding Handbook*, Volume 2, Eighth Edition, American Welding Society, Chapter 3, pages 74–107) welding techniques, the thin tag material typically is "blown" out and the weld, if any, is a weak meniscus about the hole in the tag (these references being expressly incorporated herein by reference). Additionally, the arc initiation is unreliable due to variable scale on the product as well as the resistive tag coating.

The use of a thicker "folded end", as is proposed herein, permits reliable MIG welding, then, to proceed based on its thickness and exposed bare metal. By "folded" is meant that an end of the tag has at least one end whose bottom has bare metal and which end is bent in a such a manner so as to expose the bare bottom side adjacent to the upper imprinted side of the tag and to increase the thickness of the thus-bent or plicated end so as to increase its thickness for welding attachment to a workpiece. Appropriate bending or folding can include, inter alia, rolling, plicating, enfolding, etc. So long as the bottom bare surface is exposed adjacent to the imprinted top surface and the thickness is increased for weld attachment to a workpiece, a novel tag as disclosed herein has been made.

Figures 1, 2, 3, 4, 5, 6:
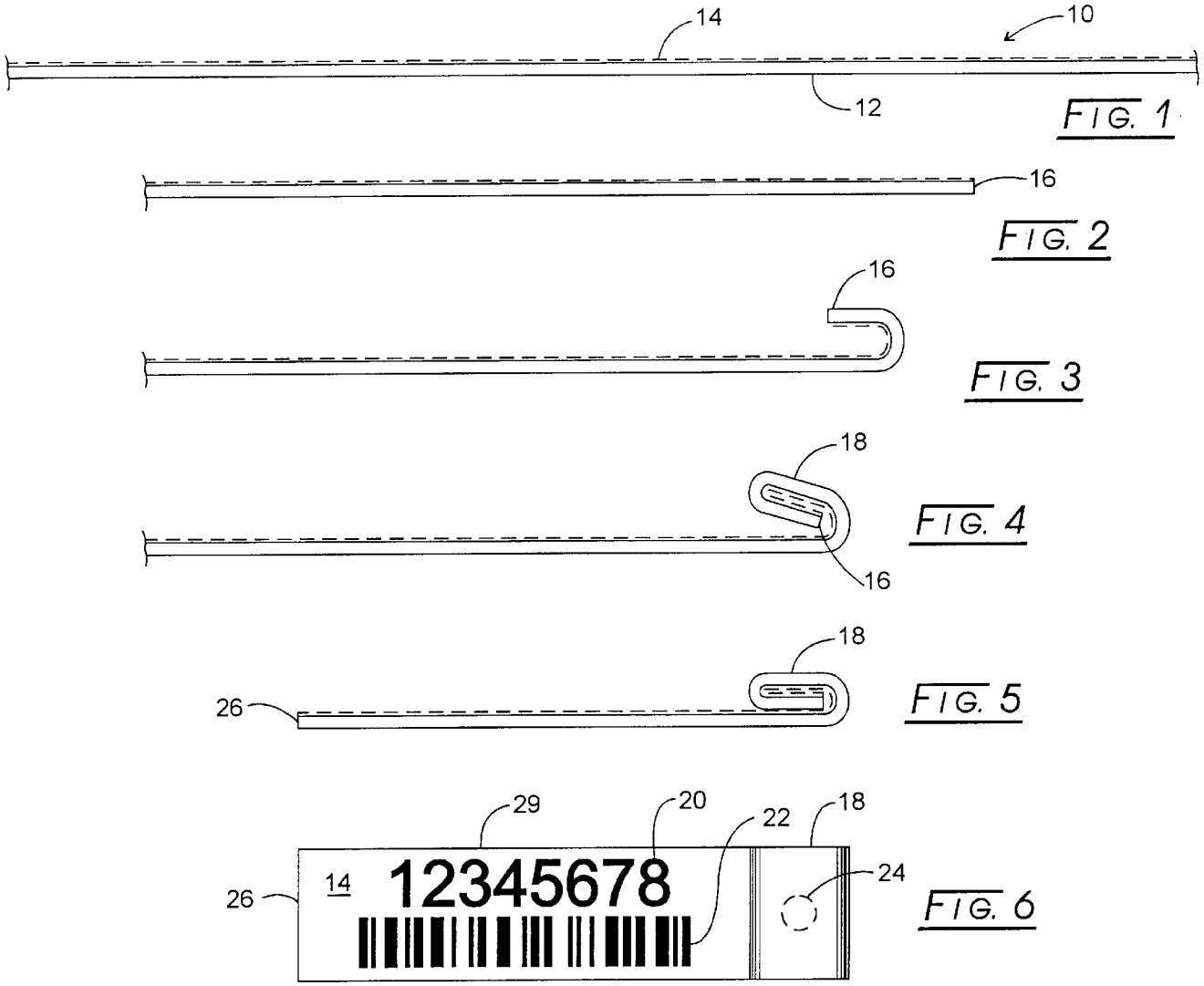
FIG. 1 is a side sectional view of roll stock metal tag material which has been coated with a coating, e.g., insulating, white, markable coating, and marked with visible indicia.
FIG. 2 is the roll stock of FIG. 1 in which has been sheared to create an end.
FIG. 3 is the roll stock end of FIG. 2 wherein the end has been folded once back towards the roll stock.
FIG. 4 is the once-folded roll stock end of FIG. 3 wherein the once-folded end is being folded a second time to continue to reveal its uncoated bottom facing upwards adjacent to the coated area of the roll stock.
FIG. 5 is the completed twice-folded roll stock end of FIG. 4 wherein a second end has been created by shearing.
FIG. 6 is an overhead view of the twice-folded roll stock tag of FIG. 5 showing visible indicia in the form of numbers and a corresponding picket fence bar code, wherein the twice-folded end is suitable for typical MIG weld attachment to a metal product.

Referring initially to FIG. 1, volume production of metal tags necessitates assembly line automation. To this end, tag stock 10 is composed of metal tag material 12 which has a lower bare face and an upper face which has been coated with (white) coating 14 and then imaged (see FIG. 6). Tag material 12 typically is between about 0.1 and 0.5 mm thick and can be made from a variety of metals, such as steel, both mild and stainless, aluminum, or the like. Stainless steel is preferred for its longevity and resistance to corrosion. Coating 14, typically a white coating ranging between about 0.05 and 2 mm in thickness, is applied to the top face of tag material 12 to provide a darkenable background for alphanumeric characters and graphics.

As seen in FIG. 2, tag stock 10 can be cut to form end 16. End 16, as shown in FIG. 3, can be folded back onto the upper coated face of tag stock 10 once and then a second time as shown in FIG. 4, with end 16 tucked back inside the double fold to create folded end 18 which consists of 3 layers of tag material 12 with the bare metal bottom of tag material 12 being exposed upwardly in adjacency with coating 14.

FIG. 6 shows a top view of the double-folded end 18 tag where numeral sequence 20 and corresponding picket fence bar code 22 are seen to have been imaged onto coating 14. Attachment of end 18 to a metal product by (MIG) welding at location 24 would exhibit resistance to thin tag "blow-out" by virtue of the extra thickness created at folded end 18. It should be noted that in FIGS. 5 and 6 that end 26 also was created, e.g., by shearing of tag material 12 to create tag 29 which is adapted to attachment to a workpiece at one end only.

It should be observed that the indicia can be made by a variety of methods, including laser marking, preferably by a laser in accordance with in commonly-assigned application Ser. No. 08/661,063, filed on Jun. 10, 1996, ink-jet marking, and thermal transfer marking techniques. The indicia can be made prior to shearing of the tag stock, prior to folding or bending of the end, or even after the final tag has been cut to length. Such marking flexibility is an advantage to the manufacturer.

Referring to FIGS. 7–12, it will be observed that the right hand end of tag stock 10 has been sheared and double folded as described in connection with FIGS. 1–6. Additionally, however, end 28 has been created in FIG. 8 by shearing of tag stock 10, and folded twice to created double-folded end 30 which also consists of 3 layers of tag material 12, again with the bare metal bottom face now upwardly disposed adjacent to coating 14 (in the same manner as end 18 was created).

Now, tag 34 can be attached to a metal product by (MIG) welding at both locations 24 and 32. Again, tag end 30 is resistant to thin tag blowout by virtue of the extra thickness which have been created. Moreover, since bare metal is exposed on the upper side of tag 34, MIG weld start-up can proceed readily. Each adjacent tag cut from tag stock 10 can be imprinted with the same message or with different messages, e.g., identification codes or serial numbers.

Figure 13:
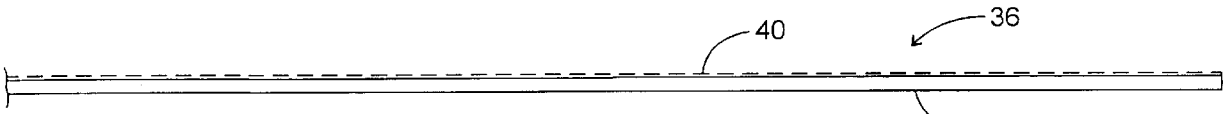
FIG. 13 a side sectional view of coated, marked, roll stock metal tag material like that depicted in FIG. 1 which has been sheared to create an end.
Figure 14:
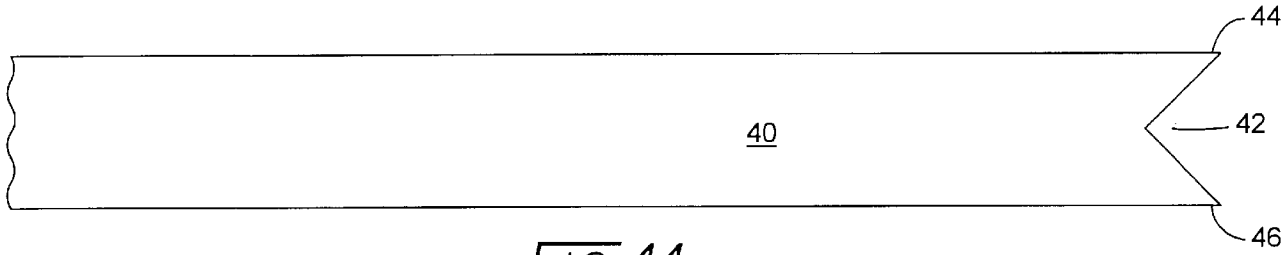
FIG. 14 is an overhead view of the roll stock metal tag material of FIG. 13 showing its V-notched end.
Figure 15:
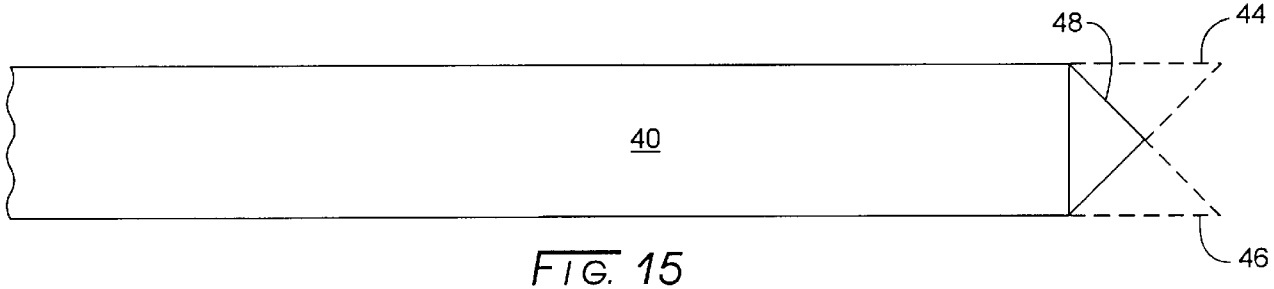
FIG. 15 is the V-notched tag of FIG. 14 wherein the legs of the notch have been folded inwardly to create an end arrow.
Figure 16:
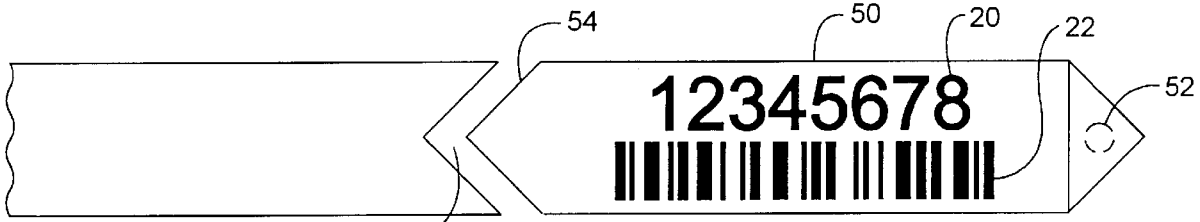
FIG. 16 is the folded arrow tag of FIG. 15, like that described in FIGS. 6 and 12, which has been sheared at the other end to create a V-notch on the adjacent sheared end, whereby the bare metal arrow is exposed for MIG weld attachment.
Figure 17:
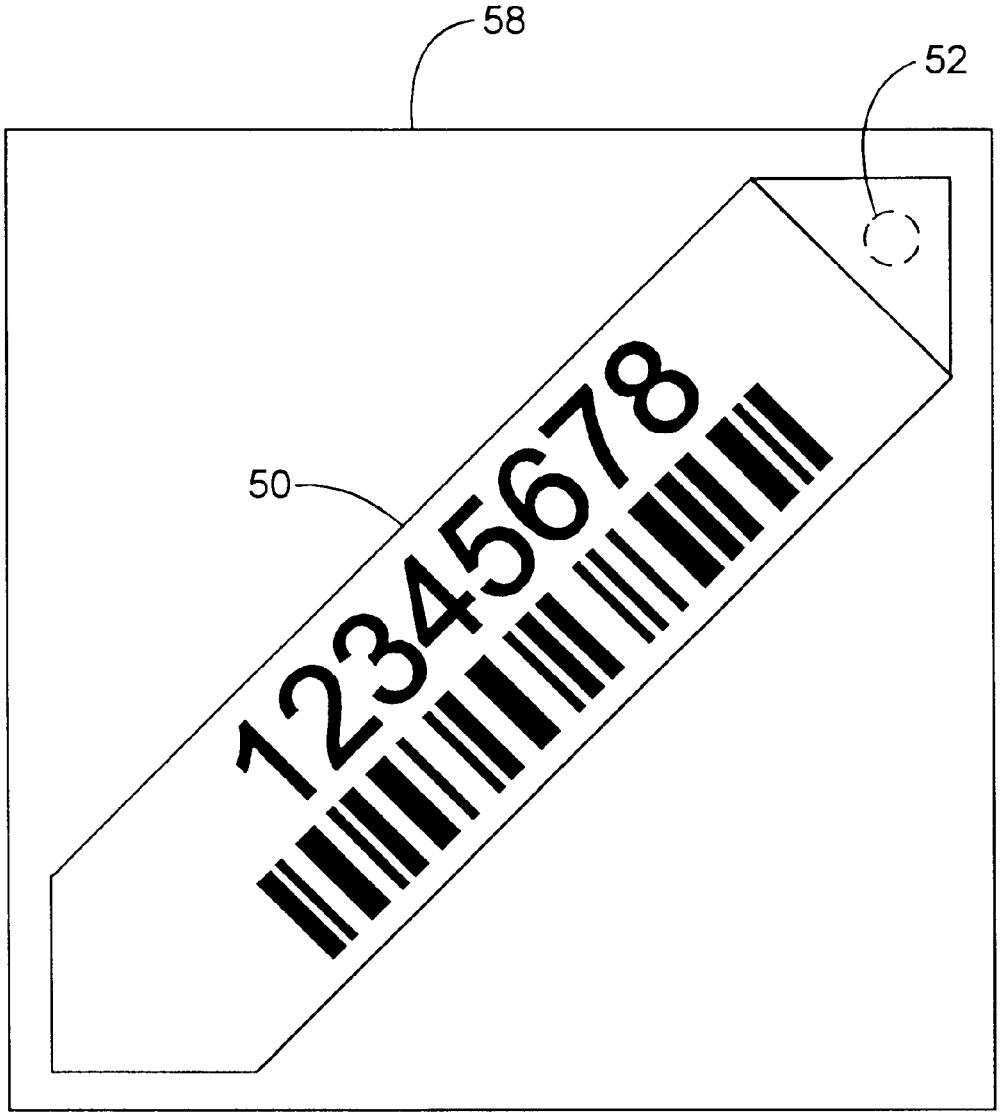
FIG. 17 shows the folded arrow tag of FIG. 16 placed diagonally on a billet end and attached by MIG welding.
Figure 18:
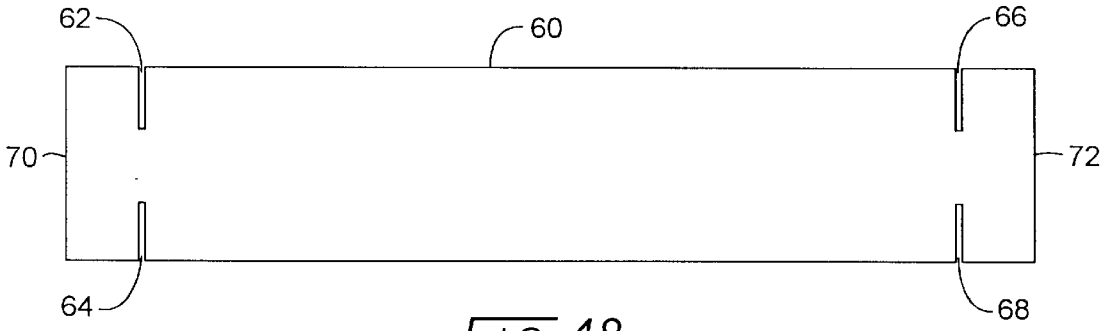
FIG. 18 is an overhead view of another embodiment of the present invention wherein notches have been cut into the sides of the tag stock to create rectangular tab ends.
Figure 19:
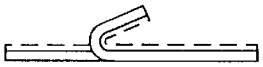
FIG. 19 is an end view of the tag stock of FIG. 18 wherein one of the ends of the tab is being folded inwardly.
Figure 20:
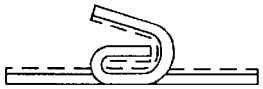
FIG. 20 is the end view of the tag stock FIG. 19 wherein the confronting tag is being folded inwardly on top of the first inwardly folded tab end.
Figure 21:
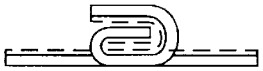
FIG. 21 is the end view of the tag stock of FIG. 20 wherein both tab ends have been inwardly folded on top of each other so as to expose the bare metal bottom on the face side of the tag stock.
Figure 22:
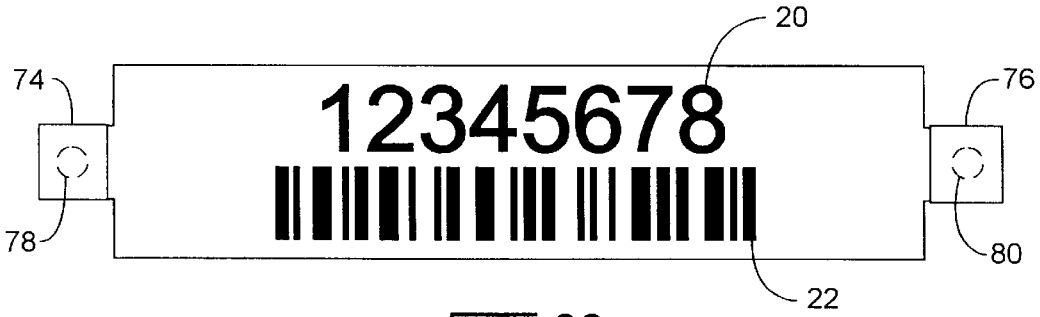
FIG. 22 is an overhead view of the tag stock of FIG. 21 showing where the folded tab ends can be used for MIG weld attachment and showing visible indicia in the form of numbers and a corresponding picket fence bar code like that described in FIG. 6.

The tag shown in FIGS. 13–16 depict another embodiment has a different end configuration than that shown in the FIGS. 1–12. In FIG. 13, tag stock 36 is made from metal tag material 38 which has a bare metal lower surface with its oppositely-disposed upper surface coated with coating 40. As can be seen from FIG. 14, end 42 has been cut to form a V-notch that consists of legs 44 and 46. By folding legs 44/46 inwardly towards the V-notch, triangular or arrow 48 is produced. Of importance is that the bare metal underneath side of tag stock 38 now has been exposed adjacent to the upper surface of tag stock 38 coated with coating 40. This means that tag 50 can be MIG welded at location 52 to a metal product to be labeled therewith. By cutting the end opposite to end 42 in a triangular or arrow configuration, as at end 54, another V-notch end 56 has been created from tag stock 36 for the creation of another inventive label. As with tag 29, MIG weld attachment of tag 50 is at one end only. An advantage of the arrow configuration of tag 50 is that is can be readily welded onto the end of a steel billet, as shown in FIG. 17 where tag 50 is in position to be welded onto the end of billet 58 at location 52.

Referring to FIGS. 18–22, it will observed that tag stock 60 has a pair of oppositely-disposed cuts 62/64 and 66/68 which have been made on ends 70 and 72, respectively, to create end legs. Each of these legs can be folded inwardly toward the other leg, as shown in FIGS. 19, 20, and 21, to again create three layers of metal tab thickness at the ends of tag 60. As before, the bare metal bottom or underneath side of tag 60 has been exposed adjacent the top, painted face of tag 60. Such bi-fold manipulation of notched ends 70 and 72 result in tabs 74 and 76 that can be weld attached to a metal product or workpiece at locations 78 and 80, respectively. Note, that only one end of tag 60 need be cut to form a triple-thick end tab for attachment, or both lends can be nicked at shown in the drawings.

It should be appreciated that the foregoing descriptive is illustrative of the present invention and should not be construed as limiting it. All citations referred to herein are expressly incorporated herein by reference.

We claim:

1. A metal tag bearing indicia thereon and which can be welded onto a metal workpiece, which comprises:

a metal sheet having a top face, a bottom face, and a pair of ends, the top face bearing a painted zone upon which is imprinted visible indicia, at least one of the ends of the bottom face having exposed bare metal, said bare metal end having been folded so as to reveal said bottom face bare metal adjacent to said imprinted painted zone, whereby said metal tag can be welded onto a metal workpiece at said folded end.

2. The metal tag of claim 1, wherein said metal sheet is between about 0.1 and 0.5 mm thick.

3. The metal tag of claim 1, wherein said painted zone is white.

4. The metal tag of claim 1, wherein said visible indicia is one or more of machine readable characters, human readable characters, or graphics.

5. The metal tag of claim 1, wherein both of said bottom face ends are folded so as to reveal said bottom face bare metal.

6. The metal tag of claim 1, wherein said bottom face end is folded inwardly twice to create 3 thickness layers of said metal sheet.

7. The metal tag claim 6, wherein both of said bottom face ends are twice folded inwardly.

8. The metal tag of claim 1, wherein at least one end of said metal sheet contains an inward V notch, each leg of which has been folded inwardly to form an outward V.

9. The metal tag claim 8, wherein both of said metal tag ends contain an inward V notch, each leg of which has been folded inwardly to form an outward V.

10. The metal tag of claim 1, wherein at least one end of said metal sheet contains oppositely disposed notches to create end legs which legs are folded toward each other to create a tab.

11. A method for making a metal tag bearing indicia thereon and which can be welded onto a metal workpiece, which comprises:

(a) providing a metal sheet having a top face, a bottom face, and a pair of ends, the top face bearing a painted zone upon which is imprinted visible indicia, at least one of the ends of the bottom face having exposed bare metal; and (b) folding said bare metal end so as to reveal said bottom face bare metal adjacent to said imprinted painted zone, whereby said metal tag can be welded onto a metal workpiece at said folded end.

12. The method of claim 11, wherein said metal sheet with said folded end is welded onto a metal workpiece at said folded end.

13. The method of claim 11, wherein said painted zone is painted white.

14. The method of claim 11, wherein said painted zone is imprinted with visible indicia selected from one or more of machine readable characters, human readable characters, or graphics.

15. The method of claim 11, wherein both of said bottom face ends are folded so as to reveal said bottom face bare metal.

16. The method of claim 11, wherein said bottom face end is folded inwardly twice to create 3 thickness layers of said metal sheet.

17. The method of claim 16, wherein both of said bottom face ends are twice folded inwardly.

18. The method of claim 11, wherein an inward V notch is formed at least at one end of said metal sheet to form legs and then each leg is folded inwardly to form an outward V.

19. The method claim 18, wherein an inward V notch is formed at both ends of said metal sheet for form legs at each end and each leg of which is folded inwardly to form an outward V at both ends.

20. The method of claim 11, wherein notches are formed at least one at end of said metal sheet to create an end legs and each leg is folded toward each other to create a tab.

* * * * *